United States Patent [19]

Carlsson et al.

[11] Patent Number: 4,944,272

[45] Date of Patent: Jul. 31, 1990

[54] CARBURETOR ARRANGEMENT

[75] Inventors: Bo P. I. Carlsson, Lerum; Ulf M. Svensson, Trollhättan, both of Sweden

[73] Assignee: Aktiebolaget Electrolux, Stockholm, Sweden

[21] Appl. No.: 269,460

[22] Filed: Nov. 10, 1988

[30] Foreign Application Priority Data

Nov. 23, 1987 [SE] Sweden ..... 8704628

[51] Int. Cl.[5] ..... F02D 1/06

[52] U.S. Cl. ..... 123/438; 261/35; 261/DIG. 68

[58] Field of Search ..... 123/438, 440; 261/35, 261/DIG. 67, DIG. 68

[56] References Cited

U.S. PATENT DOCUMENTS

| | | | |
|---|---|---|---|
| 3,730,157 | 5/1973 | Gerhold | 60/285 |
| 3,742,924 | 7/1973 | Bachle | 60/276 |
| 3,921,612 | 11/1975 | Aono | 123/438 |
| 3,974,813 | 8/1976 | Knapp et al. | 261/DIG. 67 |
| 4,034,727 | 7/1977 | Aono et al. | 123/440 |
| 4,034,730 | 7/1977 | Ayres et al. | 123/440 |
| 4,089,311 | 5/1978 | Brettschneider et al. | 123/440 |
| 4,787,356 | 11/1988 | Rösgen et al. | 123/438 |

*Primary Examiner*—Tony M. Argenbright
*Assistant Examiner*—Robert E. Mates
*Attorney, Agent, or Firm*—Pearne, Gordon, McCoy & Granger

[57] ABSTRACT

The invention is an arrangement for controlling the air/fuel ratio A/F in a carburetor. The arrangement can be connected to a membrane or a float carburetor and controls the mixture ratio by influence on the differential pressure Δp between the fuel chamber (18) and the venturi (12). The subpressure from some part of the intake system (16) is passed through a magnetic valve (32) activated by pulses of a variable length. In order to equalize the whole or part of the subpressure there is an opening (33) with inlet from the atmosphere to the valve. By varying the pulse length a changeable subpressure is obtained which is connected in lieu of the regular atmospheric ventilation of the carburetor.

8 Claims, 3 Drawing Sheets

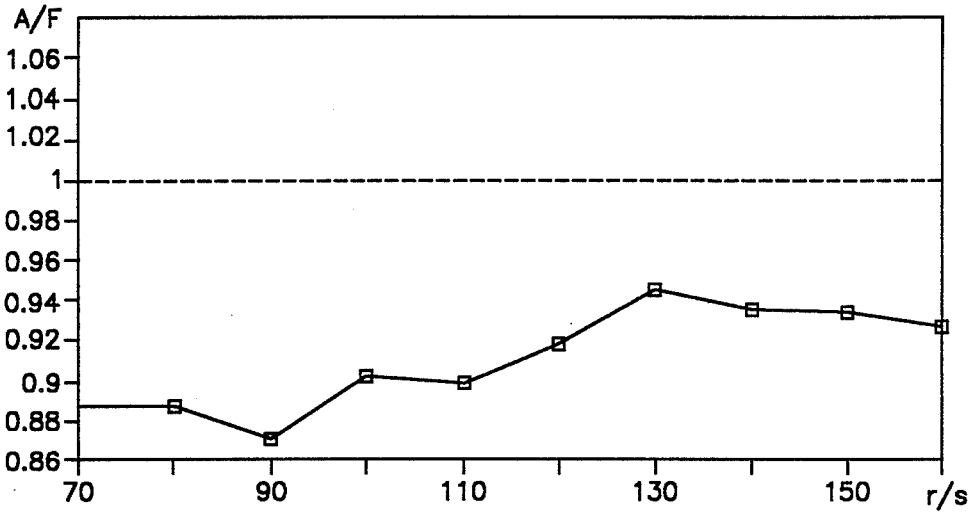
Fig.1
Fig.2
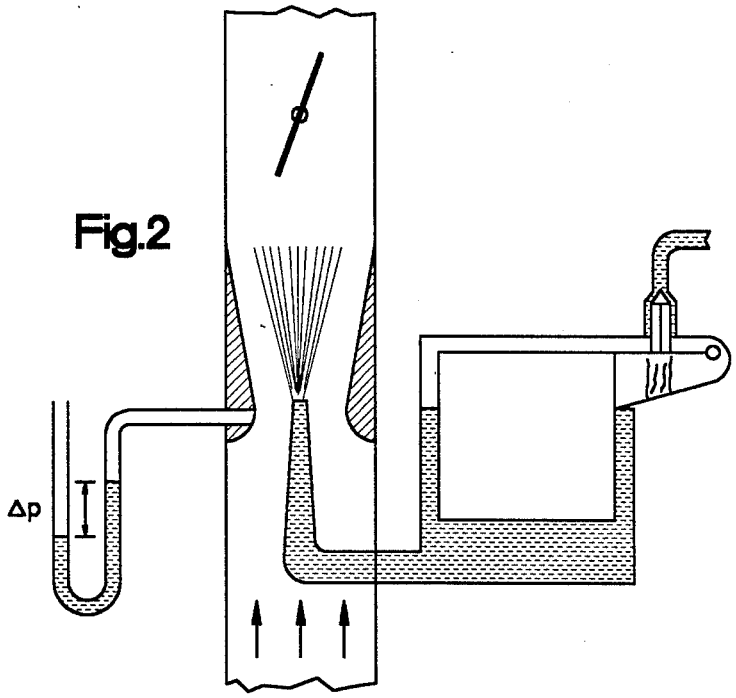

CARBURETOR ARRANGEMENT

BACKGROUND AND SUMMARY OF THE INVENTION

The present invention relates to a control arrangement concerning the air/fuel ratio in a carburetor of a combustion engine The ratio of the air/fuel mixture (designation A/F) as far as combustion engines are concerned has lately become a more interesting matter since—for environmental reasons—engines as "clean" as possible are desired.

In order to obtain clean exhaust gases from the engine it is necessary to burn the air/fuel mixture as efficiently as possible. It has since long been a difficult problem to control the mixture ratio with regard to different operating conditions of the engine. A simple membrane carburetor of the type used for example, in chain saws has an uneven ratio of A/F mixture along the r.p.m. range (r/s) of the engine. Sample values taken on an engine with a carburetor of that kind show (FIG. 1) that the diffusion of the function A/F with regard to r/s is considerable. In FIG. 1 the A/F values are indicated in proportion (0.94, 0.96, 0.98 etc.) to an ideal value of set at a value of 1. The values have been measured on a carburtor set on a rich mixture and, therefore, the curve does not in any point reach the ideal value 1. Different settings of the adjustment screws on the carburetor indicate, however, that the uneveness of A/F cannot be eliminated, so it is necessary to apply another kind of adjustment depending on r.p.m. and load.

Due to the present invention the problem of equalizing the A/F function and setting it on an ideal value has been solved by means of a control device on the carburetor which, depending on load and r.p.m., controls the differential pressure ($\Delta p$) in the carburetor. This pressure is defined in the simplest way by considering a float carburetor (FIG. 2) where, on one hand there, is an atmospheric pressure in the chamber, and, on the other, a subpressure in the venturi tube through the carburetor. The differential pressure $\Delta p$ is the difference between those two pressures. In analogy thereof a membrane carburetor has also a $\Delta p$, being the difference between the pressure prevailing on the dry side of the membrane (reference pressure) and the said subpressure. The arrangement acts on a carburetor which, in its starting position with reference pressure=atmospheric pressure, is set on a rich mixture (curve according to FIG. 1) but which in different operating conditions, due to the action of the arrangement, gets a reduced reference pressure, i.e. a subpressure, on the membrane or in the float chamber so that A/F increases (is raised) to the desired ideal value. This occurs by control of $\Delta p$. A carburetor arrangement apt to realize the said improvement on the conditions given shall, according to the invention, have the characteristics stated in claim 1.

An embodiment of the carburetor arrangement according to the invention will now be described with reference to the attached drawings.

BRIEF DESCRIPTION OF THE DRAWINGS

FIG. 1 is a diagram of A/F as a function of r.p.m.,

FIG. 2 is a float carburetor in cross section,

DESCRIPTION OF THE PREFERRED EMBODIMENT

Figure 3:
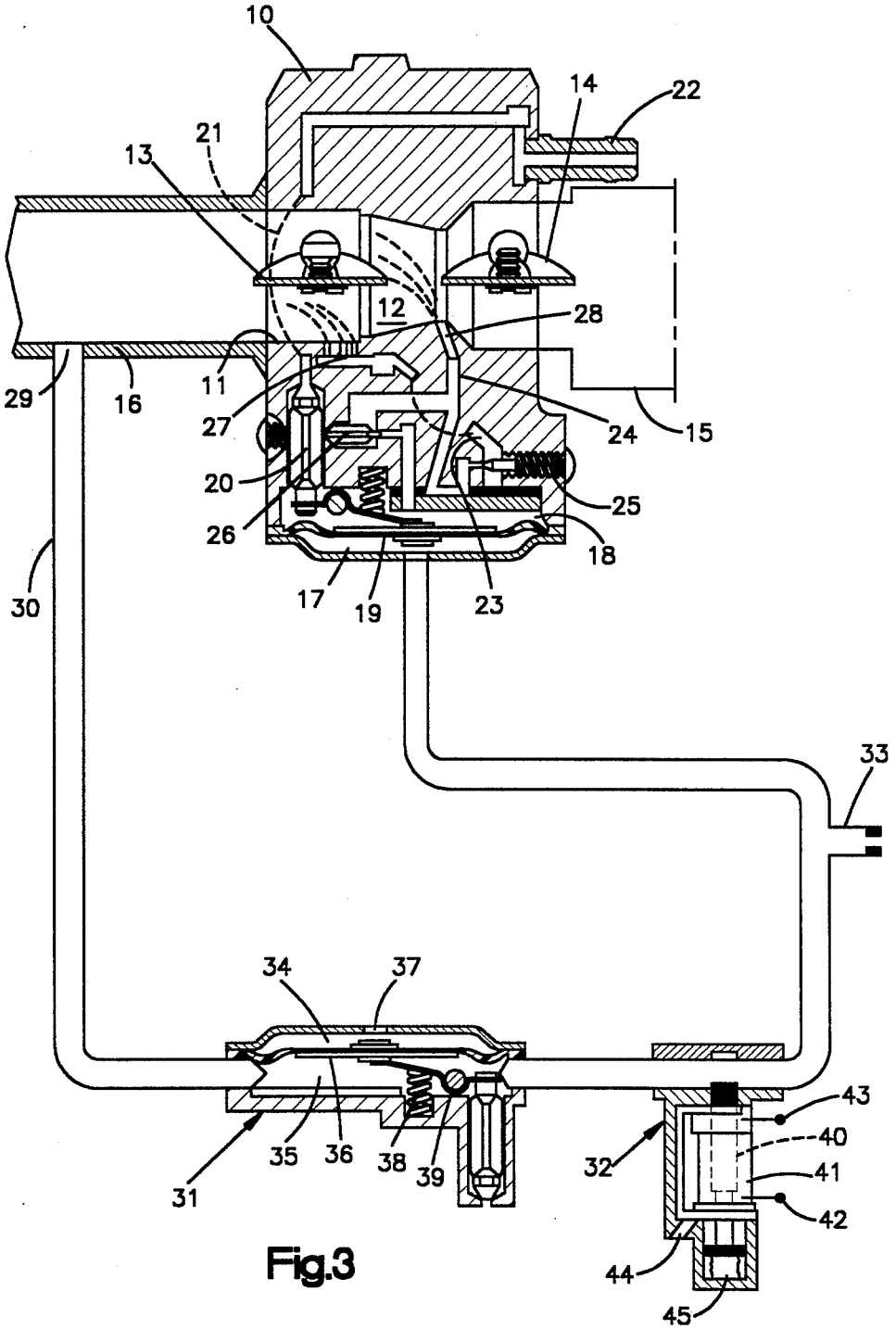
FIG. 3 is a membrane carburetor with a connection diagram for the carburetor arrangement.

The general design of the arrangement according to the invention is illustrated in FIG. 3 which is a cross-section of the arrangement. A carburetor housing 10 of a membrane carburetor has a flow channel 11 with a venturi 12, a throttle 13 and a choke 14. The inlet end of the channel is connected to an air filter 15 and the outlet end to a connecting tube 16 of an engine. The lower part of the housing 10 comprises an air chamber 17 as well as a fuel chamber 18 which are separated by a membrane 19. This acts in the usual way on an inlet valve 20 for fuel which enters by way of conduits 21 and a tube 22 from a pump. From the fuel chamber fuel is passed through conduits 23, 24 and the needle screw 25, 26 to a couple of nozzles 27, 28 in the side wall of the channel 11. This is an ordinary embodiment of a membrane carburetor and need not therefore be explained in detail.

In the following the specific part of the arrangement relating to the accessories of the membrane carburetor will be described. The accessories are included in an association of a pressure outlet 29 in the tube 16 having connection to a pipe 30, a pressure regulator 31, a magnetic valve 32, an equalizing opening 33 and a connection to the air chamber 17.

When operating, a subpressure varying with load and r.p.m. appears in the tube. The pressure regulator limits the subpressure to a value suitably selected in relation to the desired A/F control range and the pressure drop in the venturi. In the example illustrated it has a design similar to the membrane mechanism in the carburetor. Consequently, it has two chambers 34, 35 separated by a membrane 36 which controls an air inlet valve. The one chamber 34 gets atmospheric pressure through an opening 37 in the wall of the chamber and the other chamber 35 gets via the pipe 30 the said limited subpressure due to the inlet valve and the membrane. The value of the subpressure is determined by the elasticity in the membrane and by the power of a spring 38 acting on it. Together with the subpressure and the said elasticity the spring resists the atmospheric pressure on the membrane and as soon as the subpressure changes, the spring and, accordingly, the inlet valve react via a lever 39 and quickly equalize the change in the subpressure. The latter is further passed to the magnetic valve 32 having an electromagnetically controlled valve body 40, a coil 41 with electric connections 42, 43 as well as a valve housing 44. The valve body is influenced by a spring 45 keeping the valve closed when the coil is without current. Between the valve and the carburetor is the equalizing opening 33 which gives an atomospheric pressure in the chamber 17 when the valve is closed. Then the carburetor would work in its original way as through the accessories 29–32 did not exist (see FIG. 1).

When the valve 32 is open, the subpressure from the pressure regulator acts on the carburetor. Some of the subpressure gets lost owing to the fact that air enters through the opening 33, but this loss can be neglected. To completely eliminate this loss, it is possible to use a two-way valve instead of the illustrated one-way valve 32. This two-way valve would then, at rest, keep an equalizing opening 33 open and keep it closed when operating.

When the magnetic valve is activated by pulses of current having a predetermined length, the relation between the time in the open and in the closed position will influence the size of the subpressure passed to the carburetor. The pipe 30, the volume of the air channel 17 and the pressure equalization through the opening 33 contribute towards damping the pulsing of the subpressure so that a differential pressure $\Delta p$ can be considered as a function of the length of the pulses of current. By controlling the differential pressure by a feed circuit (FIG. 4) for pulses of current having varying lengths it is possible to reach an ideal mixture ratio A/F across the complete r.p.m. range (FIG. 1, dashed line). Each engine has, however, individual non-uniform properties. The adaption of a carburetor, with the new accessories 29–33, to a special engine, is easily effected due to the control range of at least $\pm 10\%$ in the A/F function involving no other steps than the variation of the pulse length to the valve.

As mentioned above, the invention can also be applied to a float carburetor. The change effected in such a case is that the accessories are connected to the float chamber instead of the air chamber 17.

Figure 4:
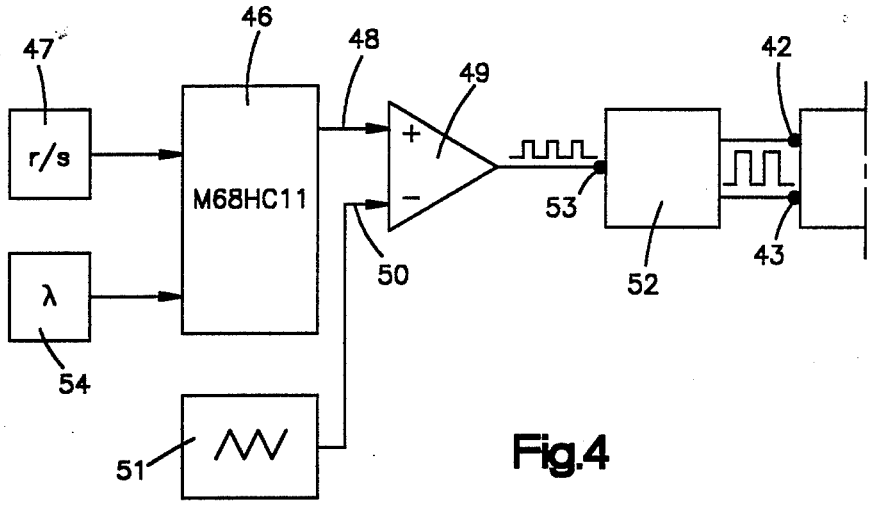
FIG. 4 is an electric diagram for the arrangement.
Figure 5:
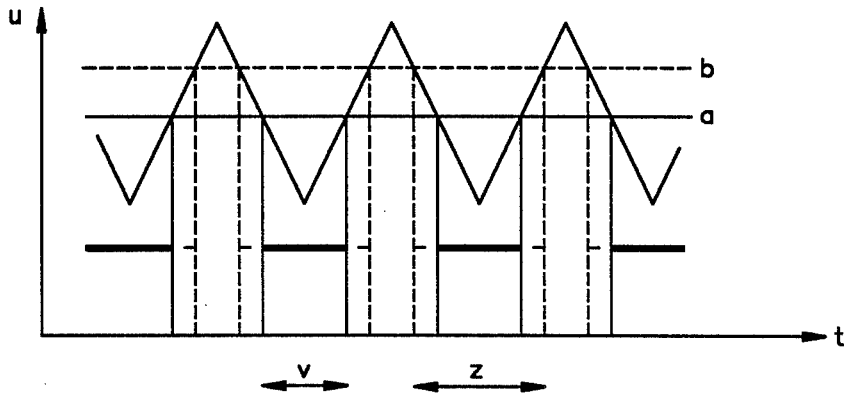
FIG. 5 is a voltage diagram.

FIG. 4 is a fundamental diagram of the feed circuit activating the magnetic valve 32. On the input side of a microprocessor 46 a signal source 47 is indicated which gives, on the basis of r.p.m. (ignition frequency), load, or the like, an r/s-value (revolutions per second) of the operating condition of the engine. On the drawing the designation of a suitable microprocessor is indicated which also has sufficient capacity for control of the ignition of the engine etc. In its memory values are stored for output signals depending on the inputs from the source 47. A control signal level then passes on a wire 48 to a comparator 49. The latter has another input 50 which receives a triangular-shaped voltage from a triangular wave generator, the frequency of which determines the pulse rate influencing the magnetic valve 32. Between the comparator and the magnetic valve there is a drive unit 52 amplifying the square pulses originating from the comparator. The latter compares the control signal level on the wire 48 to the triangular voltage on the input 50 and gives, depending on the comparison, the square pulses that are passed to input 53 of the drive unit. By increasing the control signal level the pulse length will increase. This is illustrated in FIG. 5 where a signal level a gives the pulse length v, and an increased level b provides an elongated pulse z. When the signal level exceeds the triangular voltage the pulse voltage changes into a constant voltage. The task of the drive unit is to provide the magnetic valve with sufficient pulse voltage for establishing its on/off function previously mentioned.

The stored program values in the microprocessor are based on characteristics of the A/F function without accurate regard to the possible pollutions which might exist in the exhaust gases. As a variation the system can, however, be completed with a so-called lambda-probe 54 in the exhaust pipe of the engine which probe gives a signal level which, when transformed, can replace the signal on the wire 48. This gives a feed-back from the exhaust system to the carburetor to control A/F in relation to the current oxygen surplus prevailing in the exhaust system. Such a variation can also be used in engines without a microprocessor.

The embodiment described is an example of how to exercise the invention. Of course, certain components can be exchanged or moved in the system and other ones may be added without departing from the inventive idea.

We claim:

1. A carburetor arrangement provided with a carburetor housing having a flow channel (11) where a throttle (13) and a venturi tube (12) are disposed as well as a fuel chamber (18) from which there is a connection to at least one nozzle located in the flow channel, and an air chamber (17) located beside the fuel chamber with connection to a reference pressure source, wherein the said reference pressure source comprises a pressure output (29) in the flow channel (11) or in the extension thereof (16) and a pressure regulator (31) connected to said output with a separate component (32) for an on/off control function in respect of the said reference pressure up to the connection to the air chamber and that the said separate component (32) for the on/off function is attached to a variable feed arrangement with which the mixture ratio of the carburetor is controlled in compliance with a characteristic provided by the feed arrangement, and wherein there is an opening (33) to the surrounding between the component for the on/off function and the air chamber.

2. A carburetor arrangement according to claim 1, wherein the component for the on/off function is a magnetic valve.

3. A carburetor arrangement provided with a carburetor housing having a flow channel (11) where a throttle (13) and a venturi tube (12) are disposed as well as a fuel chamber (18) from which there is a connection to at least one nozzle located in the flow channel, and an air channel (17) located beside the fuel chamber with connection to a reference pressure source, wherein the said reference pressure source comprises a pressure output (29) in the flow channel (11) or in the extension thereof (16) and a pressure regulator (31) connected to said output with a separate component (32) for an on/off control function in respect of the said reference pressure up to the connection to the air chamber and that the said separate component (32) for the on/off function is attached to a variable feed arrangement with which the mixture ratio of the carburetor is controlled in compliance with a characteristic provided by the feed arrangement, and wherein the pressure regulator (31) is of a constant pressure type.

4. A carburetor arrangement provided with a carburetor housing having a flow channel (11) where a throttle (13) and a venturi tube (12) are disposed as well as a fuel chamber (18) from which there is a connection to at least one nozzle located in the flow channel, and an air chamber (17) located beside the fuel chamber with connection to a reference pressure source, wherein the said reference pressure source comprises a pressure output (29) in the flow channel (11) or in the extension thereof (16) and a pressure regulator (31) connected to said output with a separate component (32) for an on/off control function in respect of the said reference pressure up to the connection to the air chamber and that the said separate component (32) for the on/off function is attached to a variable feed arrangement with which the mixture ratio of the carburetor is controlled in compliance with a characteristic provided by the feed arrangement, and wherein the fuel chamber and the air chamber are separated by a membrane (19) and consequently the carburetor is a membrane carburetor.

5. A carburetor arrangement provided with a carburetor housing having a flow channel (11) where a throttle (13) and a venturi tube (12) are disposed as well as a fuel chamber (18) from which there is a connection to at least one nozzle located in the flow channel, and an air chamber (17) located in the fuel chamber with connection to a reference pressure source, wherein the said reference pressure source comprises a pressure output (29) in the flow channel (11) or in the extension thereof (16) and a pressure regulator (31) connected to said output with a separate component (32) for an on/off control function in respect of the said reference pressure up to the connection to the air chamber and that the said separate component (32) for the on/off function is attached to a variable feed arrangement with which the mixture ratio of the carburetor is controlled in compliance with a characteristic provided by the feed arrangement, and wherein there is an opening (33) to the surroundings between the component for the on/off function and the air chamber.

6. A carburetor arrangement provided with a carburetor housing having a flow channel (11) where a throttle (13) and a venturi tube (12) are disposed as well as a fuel chamber (18) from which there is a connection to at least one nozzle located in the flow channel, and an air chamber (17) located in the fuel chamber with connection to a reference pressure source, wherein the said reference pressure source comprises a pressure output (29) in the flow channel (11) or in the extension thereof (16) and a pressure regulator (31) connected to said output with a separate component (32) for an on/off control function in respect of the said reference pressure up to the connection to the air chamber and that the said separate component (32) for the on/off function is attached to a variable feed arrangement with which the mixture ratio of the carburetor is controlled in compliance with a characteristic provided by the feed arrangement, and wherein the pressure regulator (31) is of a constant pressure type.

7. A carburetor arrangement provided with a carburetor housing having a flow channel (11) where a throttle (13) and a venturi tube (12) are disposed as well as a fuel chamber (18) from which there is a connection to at least one nozzle located in the flow channel, and an air chamber (17) located in the fuel chamber with connection to a reference pressure source, wherein the said reference pressure source comprises a pressure output (29) in the flow channel (11) or in the extension thereof (16) and a pressure regulator (31) connected to said output with a separate component (32) for an on/off control function in respect of the said reference pressure up to the connection to the air chamber and that the said separate component (32) for the on/off function is attached to a variable feed arrangement with which the mixture ratio of the carburetor is controlled in compliance with a characteristic provided by the feed arrangement, and wherein the fuel chamber and the air chamber are separated by a membrane (19) and consequently the carburetor is a membrane carburetor.

8. A carburetor arrangement according to claim 5, wherein the component for the on/off function is a magnetic valve.

* * * * *